United States Patent [19]

Panzica

[11] Patent Number: 4,869,213

[45] Date of Patent: Sep. 26, 1989

[54] MOTORCYCLE BREATHER VALVE ADJUSTMENT SYSTEM AND METHOD

[75] Inventor: Ignatius J. Panzica, Morgan Hill, Calif.

[73] Assignee: Custom 'Chrome, Inc., Morgan Hill, Calif.

[21] Appl. No.: 174,229

[22] Filed: Mar. 28, 1988

[51] Int. Cl.[4] ..... F02B 33/04; F01M 1/00

[52] U.S. Cl. ..... 123/73 AD; 123/196 CP

[58] Field of Search ..... 123/73 AD, 196 R, 196 CP

[56] References Cited

U.S. PATENT DOCUMENTS

| | | | |
|---|---|---|---|
| 2,111,242 | 3/1938 | Harley | 123/196 CP |
| 4,142,487 | 3/1979 | Somraty | 123/196 CP |
| 4,532,897 | 8/1985 | Metzger | 123/196 R |
| 4,765,291 | 8/1988 | Kurio et al. | 123/73 AD |

*Primary Examiner*—Willis R. Wolfe
*Assistant Examiner*—M. Macy
*Attorney, Agent, or Firm*—William W. Haefliger

[57] ABSTRACT

A system is provided for relieving gas pressure developed in a crank case under an internal combustion engine piston as the reciprocating piston travels from top dead center toward and beyond bottom dead center, and wherein a rotary breather valve is employed. The rotary valve has a rotary sleeve rotatable within a fixed sleeve, the rotary and fixed sleeves respectively having first and second arcuate ports which come into increasing and decreasing registration in timed relation to the piston travel, such decreasing registration terminating after the piston reaches bottom dead center. Oil and air mist are discharged through the registered ports during said piston travel. In this system, a method for compensating for the replacement of a relatively smaller displacement piston chamber with a relatively larger displacement piston chamber is provided, said method including:

(a) removing a first rotary sleeve from the fixed sleeve, the first sleeve provided on a first rotary valve and characterized as having an arcuate port subtending an angle $\alpha_1$, which terminates such decreasing registration after the piston travels a distance $d_1$ beyond bottom dead center, (b) providing a second rotary breather valve having a second rotary sleeve characterized as having an arcuate port subtending an angle $\alpha_2$, where $\alpha_2 > \alpha_1$, (c) and installing the second rotary sleeve into the fixed sleeve so that it rotates to terminate such decreasing registration after the piston has traveled a distance $d_2$ beyond piston bottom dead center, where $d_2 > d_1$.

6 Claims, 3 Drawing Sheets

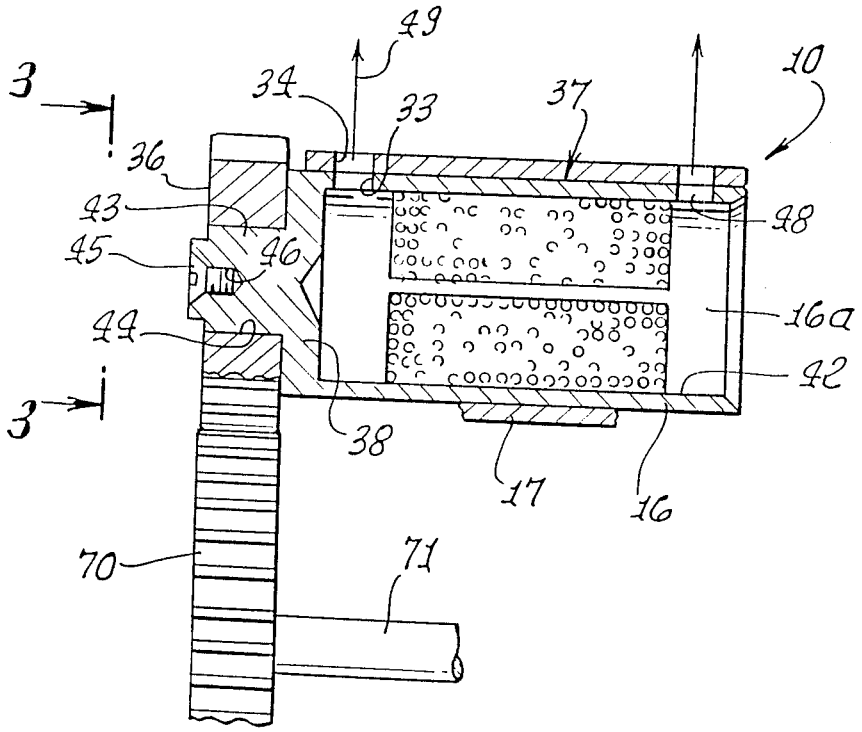
FIG. 2.
FIG. 4.
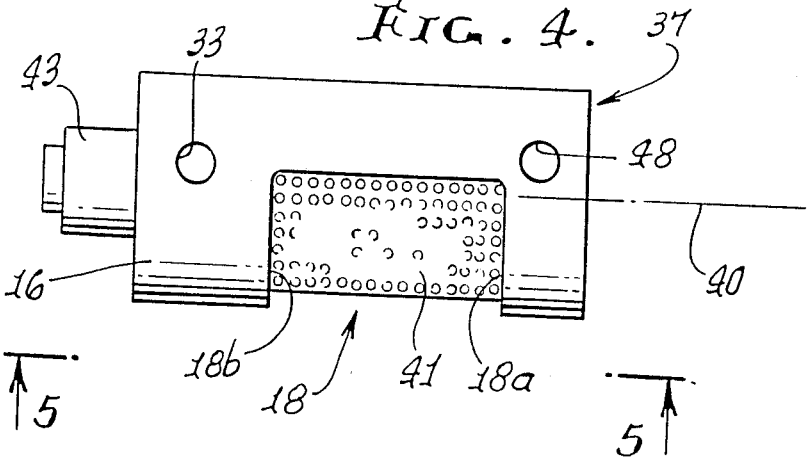
FIG. 5.
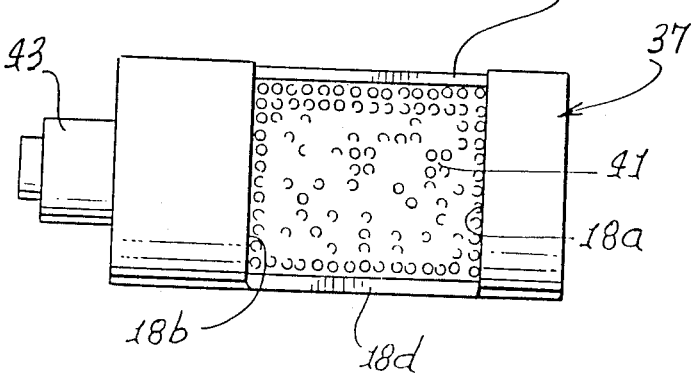

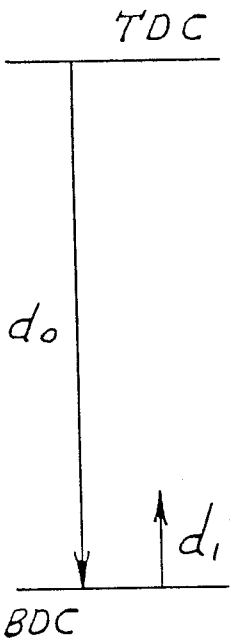
FIG. (6b)
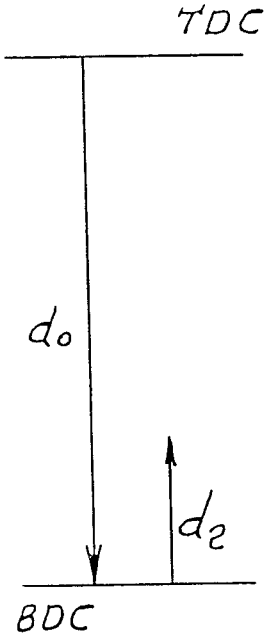
FIG. (6d)
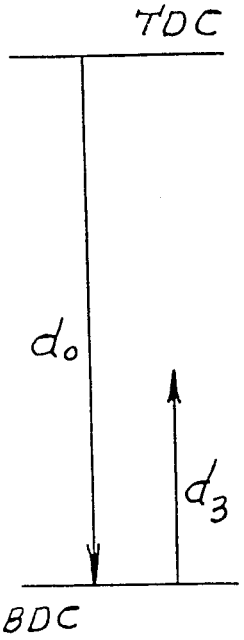
FIG. (6f)
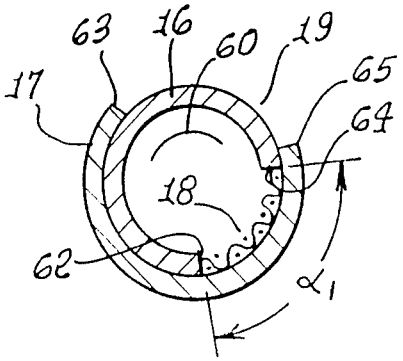
FIG. (6a)
$\alpha_1 \sim d_0 + d_1$
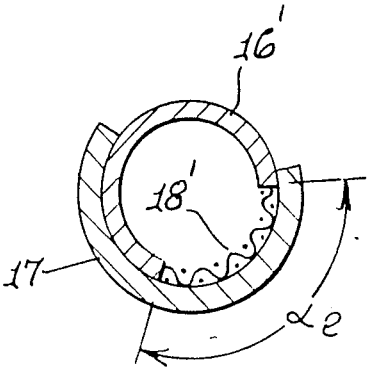
FIG. (6c)
$\alpha_2 \sim d_0 + d_2$
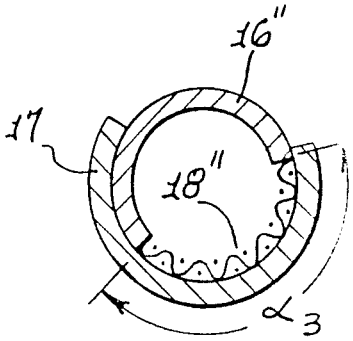
FIG. (6e)
$\alpha_3 \sim d_0 + d_3$

MOTORCYCLE BREATHER VALVE ADJUSTMENT SYSTEM AND METHOD

BACKGROUND OF THE INVENTION

This invention relates generally to rotary breather valves as used in Harley Davidson motorcycle engine, and more particularly concerns construction, installation and adjustment of such valves, to accommodate to different sized(displacement) engine combustion chambers.

Rotary breather valves are employed on such motorcycle engines for relieving gas pressure developed in the engine crank case as the reciprocating piston, or pistons, travel from top dead center (TDC) toward and beyond bottom dead center(BDC) positions in the cylinder or cylinders. Such a breather valve has a rotary sleeve installed to be rotatable within a fixed sleeve, the rotary and fixed sleeves respectively having first and second arcuate ports, i.e. windows, which come into increasing and decreasing registration in timed relation to such piston travel. Such decreasing registration terminates after the piston reaches BDC. While the ports are in registration, the pressure of gas in the crank case conveys oil and air mist to discharge through the ports, as via a screen at the port of the rotary valve, to lubricate the cam shaft and cams, the oil and mist then being separated.

If, however, a motorcyclist substitutes a larger displacement combustion chamber, for the prior chamber, a problem arises. The larger chamber causes development of more gas pressure in the crank case, and unwanted back pressure can develop (reducing horsepower output). In this regard, it is found that the breather valve cannot handle i.e. discharge all of the excess gas pressure developing in the crank case, which leads to the referenced development of unwanted back pressure. There is need for means to alleviate this problem.

SUMMARY OF THE INVENTION

It is a major object of the invention to provide a solution to the above described problem, and to meet the referenced need.

The method of the invention basically includes the steps:

(a) removing a first rotary sleeve from the fixed sleeve, said first sleeve provided on a first rotary valve and characterized as having an arcuate port subtending an angle $\alpha_1$, which terminates said decreasing registration after the piston travels a distance $d_1$ beyond bottom dead center, (b) providing a second rotary breather valve having a second rotary sleeve characterized as having an arcuate port subtending an angle $\alpha_2$, where $\alpha_2 > \alpha_1$, (c) and installing said second rotary sleeve into said fixed sleeve so that it rotates to terminate said decreasing registration after the piston has traveled a distance $d_2$ beyond piston bottom dead center where $d_2 > d_1$.

Accordingly, by substituting in this manner a second breather valve, of increased port length in the direction of sleeve rotation, the registration of the fixed and rotatable ports is prolonged, to allow escape of excess pressure build-up in the crank case.

It is a further object of the invention to provide the first and second breather valves with first and second timing gears respectively coaxially fitted thereon, said gears adapted to mesh with a drive gear on a shaft driven by the engine, the first gear driven to initiate said increasing registration after the piston has traveled a distance $d_4$ from top dead center toward bottom dead center, and said installation includes adjusting the rotary position of the second timing gear relative to the arcuate port on said second sleeve, to cause that gear to be driven by the drive gear to initiate said increasing registration after the piston has traveled a distance $d_4'$ from top dead center where $d_4' > d_3$.

It is a still further object of the invention to provide for such adjustment of the timing gear on the second valve by pulling that second gear off a shaft on the second valve to which it had been press fitted, coaxially relatively rotating the second gear and second sleeve, and pressing the gear back onto the shaft to have a restored press fit thereon.

In this regard, in certain circumstances the timing gear of the first breather valve may be similarly adjusted, to obviate need for using a second breather valve, as referred to.

These and other objects and advantages of the invention, as well as the details of an illustrative embodiment, will be more fully understood from the following specification and drawings, in which:

DRAWING DESCRIPTION

FIG. 2 is an elevation, in section, showing the construction of a breather valve, with driven gear attached;

FIG. 4 is an external side view of the breather valve

FIG. 5 is a side view taken on lines 5—5 of FIG. 4; and

Figure 7:
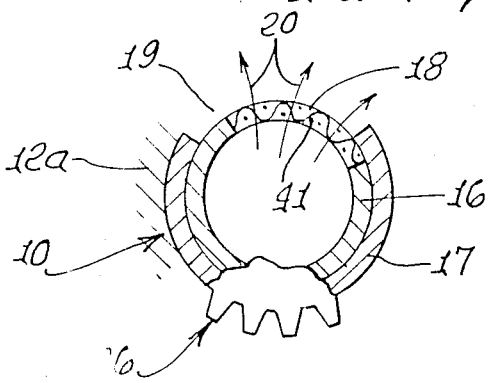

FIGS. 6(*a*)–6(*f*) are diagrammatic view showing synchronized rotation of the three different breather valves, in a set, as related to fixed sleeves and engine piston position, and FIG. 7 shows breather valve operation.

GENERAL DESCRIPTION OF OPERATION

In FIGS. 10 and 7 , the rotary breather valve 1 is located in the interior 11 of crank case 12 beneath cylinders 13 and 14 of an internal combustion engine 15. The valve has a rotary sleeve 16 rotatable (as by a gear 36) a fixed sleeve 17, the two sleeves defining curved ports or windows 18 and 19 which come into progressively increasing and then decreasing registration in timed relation to piston travel in the cylinders. Sleeve 17 is carried by walls of case 12.

During such registration, the pressure developed in the crank case by downward travel of a piston causes oil and air mist to discharge or escape from the ports of the breather valve, as indicated by arrows 20. The oil mist initially enters a cam gear compartment 21, where it lubricates the cam gear and cam shaft. Oil falling at 22 to the lower interior 23 of the case flows via exit port 23*a* and path 24 to the suction side of oil pump 26, which returns the oil to an oil filter and oil tank 27.

Separated air together with associated oil mist travels via passage 28 and port 29 to an air cleaner 30.

Upon upstroke of the piston in the cylinder, oil is drawn by vacuum from the lower interior of the chamber 21, via a passage or duct and to the breather valve, where the oil is drawn through a port or ports 33 (See FIG. 2 in the breather valve, and ultimately into the crank case interior 11. Port 33 registers with a port 34 in the fixed sleeve, during such oil travel. See FIG. 2.

As seen in FIGS. 2–5, the rotary valve has a tubular body 37 defining the sleeve 16. The latter is open at one end 16*a* to receive inflow of air and oil, and has an end wall 38 closing the opposite end of the sleeve. The port 18 is cut between parallel edges 18*a* and 18*b*, axially spaced apart, and between parallel edges 18*c* and 18*d* that extend axially, and are circularly spaced apart about the axis 40 of the sleeve. A mist forming screen 41 subtends that opening, and is carried by the sleeve, to extend arcuately proximate the cylindrical bore of the sleeve. A stem 43 integral with wall 38 is adapted to receive the cylindrical bore 44 of the gear 36, with press fit. Thus the gear can be forcibly pulled off the stem, rotated a selected amount relative to the stem, and pressed back onto the stem. Ports 33 and 48 in the sleeve 16, spaced from the port 33, are adapted to pass oil, as in direction 49 in FIG. 2, and via a registering port 34 in fixed sleeve 17, so that oil may flow into the interior 11 of the case, from the bottom of chamber 21.

Referring now to FIG. 6*a*, it shows in section the rotary breather valve sleeve 16 installed endwise axially into a fixed sleeve 17, as referred to. The ports or windows are respectively shown at 18 and 19, sleeve 16 rotating in the clockwise direction indicated by arrow 60. A screen 41 carried by sleeve 16 subtends window 18 and that window subtends angled $\alpha_1$, as shown. Sleeve 16, as shown in FIG. 6*a*may be considered as a "first" rotary sleeve, and which is removable endwise to allow substitution of a "second" rotary sleeve, to be described. Sleeve 16 in FIG. 6*a* is ported at 18 so as to open the valve (edge 62 registers with edge 65) when the engine piston 13*a* in the cylinder 13 is at top dead center (TDC) and to close the valve (edge 64 registers with edge 65, as shown) when the piston in cylinder 13*a* has traveled to bottom dead center (distance $d_O$ in FIG. 6*b*) and up past bottom dead center by amount $d_1$, as shown. Therefore, $\alpha_1$ corresponds to $d_0$ and $d_1$, i.e. $\alpha_1 \sim d_0 + d_1$.

FIG. 6*c* shows substitution of the second breather valve having a rotary sleeve 16' the same as sleeve 16 except that the port 18' subtends a longer angle $\alpha_2$ of rotation, i.e. $\alpha_2 > \alpha_1$. Also, $\alpha_2 \sim d_0 + d_2$,as indicated in FIG. 6*d*. FIG. 6*e* shows substitution of a third breather valve having a rotary sleeve 16'', the same as sleeve 16', except that the port 18'' subtends a still longer rotary angle $\alpha_3$ of rotation, i.e. $\alpha_3 > \alpha_2$. Also, $\alpha_3 \sim d_0 + d_3$, as indicated in FIG. 6*e*. Therefore, $d_3 > d_2 > d_1$, and $\alpha_3 > \alpha_2 > \alpha_1$; and the port 18'' is open a longer time than the port 18', which in turn open a longer time than port 18. Valve sleeve 16' would be substituted for sleeve 16 when a larger displacement engine combustion chamber (normally, cylinder diameter) is employed than is used with sleeve 16; and sleeve 16'' would be substituted for sleeve 16' (or 16) when a yet larger displacement engine combustion chamber is employed. This assumes that back-pressure does not deleteriously build up in the crank case, upon such substitution of a larger engine combustion chamber.

Figure 1:
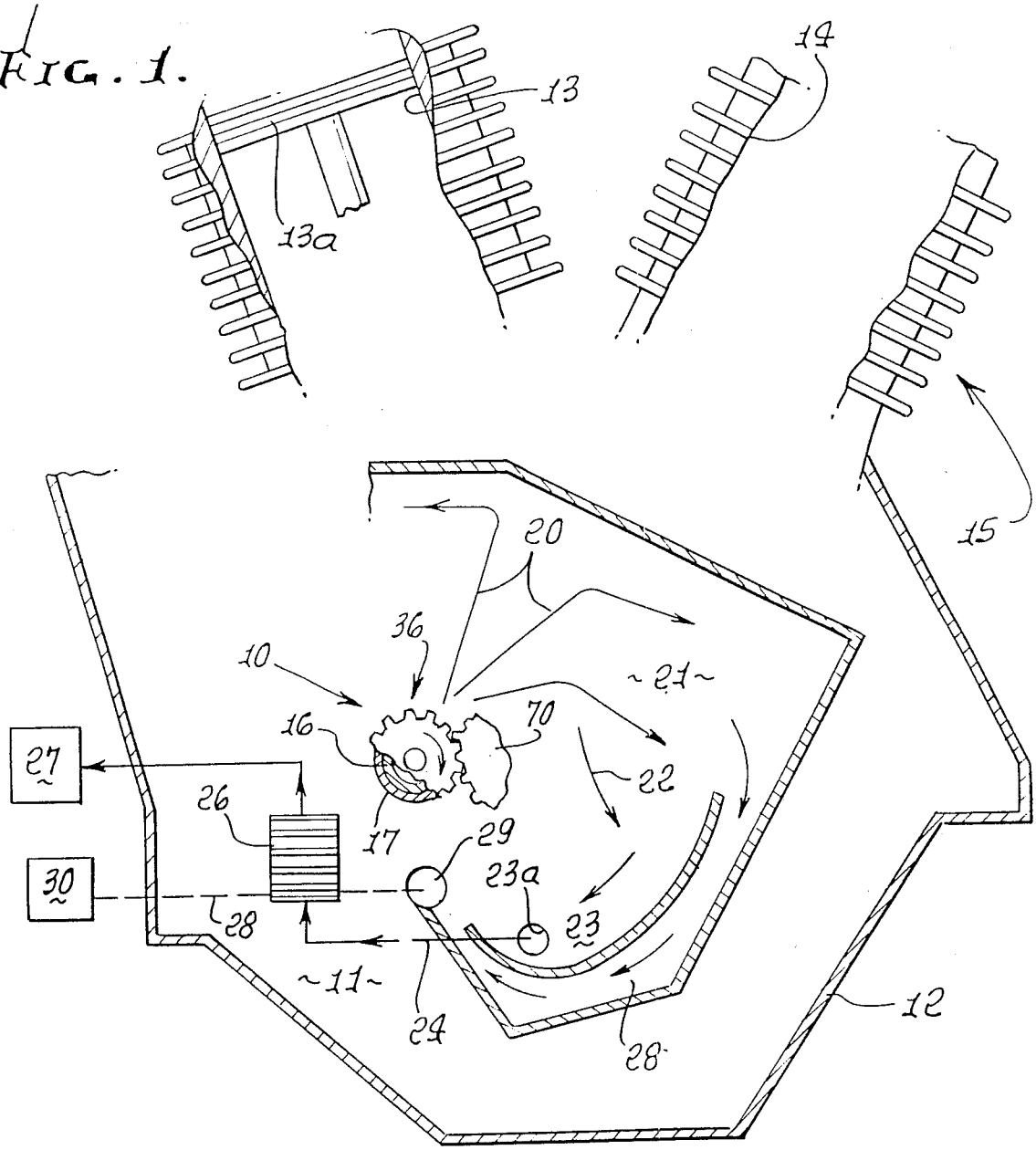
FIG. 1 is a diagrammatic view of an engine crank case, with breather valve operation depicted.

The first and second rotary breather valves have the same size and shape gear 36 thereon, to be driven for example by the gear 70 on the cam shaft 71 (see FIG. 2), and which is lubricated by the oil mist 20 discharged through the breather valve port. See FIG. 1. Gear 70 is timed to cause rotation of the breather valve in timed relation to piston travel, as described. The gear 36 is driven to initiate increasing registration of the ports 18 and 19 after the piston 13*a* has traveled a distance $d_4$ from top dead center. Normally, $d_4=0$, i.e. the ports initiate their registration at TDC; however, $d_4$ is made a selected positive distance from top dead center, if a small pressure build-up in the crank case were desired, and to this end $d_4$ is controlled or varied until maximum or near maximum horsepower output of the engine is achieved, for any selected sleeve 16, 16' and 16''. For a larger combustion chamber, $d_4'$ is chosen so that $d_4'\alpha > d_4$.

The value $d_4$ can be controlled or "tuned" by adjusting the angular position of the gear 36 on the valve stem 43, as by pulling the gear off the stem (after removal of screw 45), rotating the gear the controlled amount relative to the stem, and installing the gear back onto the stem, to achieve press fit. Such adjustment is "infinite" as to number of adjustment positions, for maximizing tuning, for any of the sleeves 16, 16' and 16'', as referred to.

Figure 3:
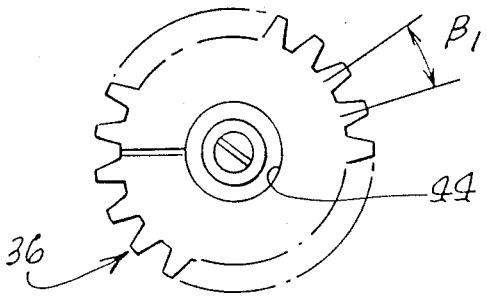
FIG. 3 is an end view on lines 3—3 of FIG. 2.

In this regard, the angular spacing of the gear teeth is $\beta_1$, as seen in FIG. 3; and the angular adjustment rotation of the gear relative to the stem is $\beta_2$, where $\beta_2$is different than $\beta_1$, yet infinitely variable.

Accordingly, the invention provides a set of breather valves, each of different rotary port angular length (i.e. $\alpha_1$,$\alpha_2$ and $\alpha_3$); and with adjustable gears thereon. Typically, the values for $\alpha_1$, $\alpha_2$ and $\alpha_3$ (for Harley Davidson motorcycle engines with different size combustion chambers) are such that:

port 18 closes 55° after BDC
18'closes 65° after BDC
port 18'' closes 75° after BDC

I claim:

1. In a system for relieving gas pressure developed in a crank case under an internal combustion engine piston as the reciprocating piston travels from top dead center toward and beyond bottom dead center, and wherein a rotary breather valve is employed, the rotary valve having a rotary sleeve rotatable within a fixed sleeve, the rotary and fixed sleeves respectively having first and second arcuate ports which come into increasing and decreasing registration in timed relation to said piston travel, such decreasing registration terminating after the piston reaches bottom dead center, oil and air mist being discharged through said registered ports during said piston travel, the method of compensating for the replacement of a relatively smaller displacement piston chamber with a relatively larger displacement piston chamber, said method including:

(a) removing a first rotary sleeve from the fixed sleeve, said first sleeve provided on a first rotary valve and characterized as having an arcuate port subtending an angle $\alpha_1$, which terminates said decreasing registration after the piston travels a distance $d_1$beyond bottom dead center, (b) providing a second rotary breather valve having a second rotary sleeve characterized as having an arcuate port subtending an angle $\alpha_2$, where $\alpha_2 > \alpha_1$, (c) and installing said second rotary sleeve into said fixed sleeve so that it rotates to terminate said decreasing registration after the piston has traveled a distance $d_2$ beyond piston bottom dead center, where $d_2 > d_1$.

2. The method of claim 1 wherein said first and second rotary breather valves have first and second like timing gears respectively coaxially fitted thereon, said gears adapted to mesh with a drive gear on a shaft driven by the engine, the first gear driven to initiate said increasing registration after the piston has traveled a distance $d_4$ from top dead center toward bottom dead center, and said installation includes adjusting the rotary position of the second timing gear on the second rotary sleeve relative to the arcuate port on said second sleeve, to cause that gear to be driven by the drive gear to initiate said increasing registration after the piston has traveled a distance $d_4$ from top dead center, where $d_4' > d_4$.

3. The method of claim 2 wherein the adjusting of the rotary position of the second timing gear on the second rotary valve is carried out by pulling the second gear off a shaft on the second valve to which it had been press fitted, coaxially relatively rotating the second gear and second sleeve, and pressing the gear back onto the shaft to have a restored press fit thereon.

4. The method of claim 3 wherein the timing gear has teeth spaced apart at angles $\alpha_1$, and said relative rotating of the gear and second sleeve defines an adjustment angle $\beta_2$ where $\beta_2$ is different than $\beta_1$.

5. The method of claim 1 including providing the same number of teeth on the first and second timing gears, all the teeth having the same size and shape.

6. The method for relieving gas pressure developed in a crank case under an internal combustion engine piston as the reciprocating piston travels from top dead center toward and beyond bottom dead center, and wherein a rotary breather valve is employed, the rotary valve having a rotary sleeve rotatable within a fixed sleeve, the rotary and fixed sleeve respectively having first and second arcuate ports which come into increasing and decreasing registration in timed relative to said piston travel, such decreasing registration terminating after the piston reaches bottom dead center, oil and air mist being discharged through said registered ports during said piston travel, the method of compensating for the replacement of a relatively smaller displacement piston chamber with a relatively larger displacement piston chamber, said method including:

(a) removing a first rotary sleeve from the fixed sleeve, said first sleeve provided on a first rotary valve and characterized as having an arcuate port subtending an angle $\alpha_1$, which terminates said decreasing registration after, the piston travels a distance $d_1$ beyond bottom dead center, (b) providing a second rotary valve having a second rotary sleeve characterized as having an arcuate port subtending an angle $\beta_2$, where $\alpha_2$, (c) installing said second rotary sleeve into said fixed sleeve so that it rotates to terminate said decreasing registration after the piston has traveled a distance $d_2$ beyond piston bottom dead center, where $d_2 \geqq d_1$, (d) said first and second rotary valves having first and second like timing gears respectively coaxially fitted thereon, said gears adapted to mesh with a drive gear on a shaft driven by the engine, the first gear driven to initiate said increasing registration after the piston has traveled a distance $d_3$ from top dead center toward bottom dead center, and said installation includes adjusting the rotary position of the second timing gear on the second rotary sleeve relative to the arcuate port on said second sleeve, to cause that gear to be driven by the drive gear to initiate said increasing registration after the piston has traveled a distance $d_4'$ from top dead center where $d_4' > d_4$.

* * * * *

UNITED STATES PATENT AND TRADEMARK OFFICE

CERTIFICATE OF CORRECTION

PATENT NO. : 4,869,213

DATED : Sept. 26, 1989

INVENTOR(S) : Ignatius J. Panzica

It is certified that error appears in the above-identified patent and that said Letters Patent is hereby corrected as shown below:

Column 6, line 14, "port subtending an angle $\beta_2$ where $\alpha_2$," should read --port subtending an angle $\alpha_2$, where $\alpha_2 \geq \alpha_1$,--

Column 6, line 10, "creasing registration after, the piston travels a dis-" should read --creasing registration after the piston travels a dis- --

Column 6, line 25, "after the piston has traveled a distance $d_3$ from top" should read --after the piston has traveled a distance $d_4$ from top--

Signed and Sealed this

Nineteenth Day of March, 1991

*Attest:*

HARRY F. MANBECK, JR.

*Attesting Officer*

*Commissioner of Patents and Trademarks*